US008082612B2

(12) United States Patent
Saunders

(10) Patent No.: US 8,082,612 B2
(45) Date of Patent: Dec. 27, 2011

(54) SHEET WITH DETACHABLE WATERPROOF PAD

(76) Inventor: Ange Saunders, Murrieta, CA (US)

( * ) Notice: Subject to any disclaimer, the term of this patent is extended or adjusted under 35 U.S.C. 154(b) by 12 days.

(21) Appl. No.: 12/048,150

(22) Filed: Mar. 13, 2008

(65) Prior Publication Data

US 2008/0222805 A1 Sep. 18, 2008

(51) Int. Cl.
*A47C 31/00* (2006.01)

(52) U.S. Cl. ..... 5/499; 5/484; 5/487; 5/502

(58) Field of Classification Search ..... 5/484, 482, 5/487, 490, 417, 420, 485, 495–502, 486, 5/488; 604/358
See application file for complete search history.

(56) References Cited

U.S. PATENT DOCUMENTS 3,066,321 A * 12/1962 Kintner ..... 5/498
3,530,487 A * 9/1970 Beer ..... 5/496
3,576,039 A * 4/1971 Roberts ..... 5/484
3,591,875 A * 7/1971 Zipf et al. ..... 5/487
3,761,973 A * 10/1973 Leventhal ..... 5/484
4,021,870 A 5/1977 Walters
4,064,577 A 12/1977 Walters
4,216,774 A * 8/1980 Graber ..... 604/371
4,599,756 A * 7/1986 Koffler ..... 5/484
4,675,925 A * 6/1987 Littleton ..... 5/607
4,922,565 A * 5/1990 Blake ..... 5/484
5,003,655 A 4/1991 Kafai
5,125,121 A * 6/1992 Wroble ..... 5/484
5,252,374 A * 10/1993 Larsonneur ..... 428/77
5,701,617 A * 12/1997 Colby ..... 5/484
5,787,527 A * 8/1998 Anderson ..... 5/484
6,233,762 B1 * 5/2001 Bradley ..... 5/484
6,243,895 B1 6/2001 Amin
6,889,397 B2 * 5/2005 Rosenberg ..... 5/655
7,047,580 B2 * 5/2006 Finn ..... 5/502
7,487,560 B2 * 2/2009 McGrath et al. ..... 5/488

* cited by examiner

*Primary Examiner* — Robert G Santos
*Assistant Examiner* — Nicholas Polito
(74) *Attorney, Agent, or Firm* — West & Associates, A PC; Stuart J. West

(57) ABSTRACT

A detachable absorbent/waterproof pad is held in place by any convenient fastening mechanism on top of a sheet. The detachable absorbent/waterproof pad can be easily changed even with a bedridden person on the bed. The detachable absorbent/waterproof pad should have a design similar to the bed sheet so as to make it inconspicuous.

12 Claims, 6 Drawing Sheets

SHEET WITH DETACHABLE WATERPROOF PAD

BACKGROUND

1. Field of the Invention

The current disclosure relates to bed sheets and bedding in general.

2. Background

Very young children, some elderly people and other bedridden people can have trouble controlling their bowels and/or bladder and can soil the bed when sleeping. It becomes a hassle to have to change the sheets frequently, especially if the person is immobile.

What is desired, therefore, is waterproof bedding that can be changed easily by a caretaker, even when the bedridden person cannot be easily moved of the bed.

What is further desired is that the waterproof bedding be pleasant to look at and not stand out as being waterproof, so as to not draw attention to the bedridden individual's incontinence problems.

What is further desired is that the waterproof bedding be held in place securely so that it does not lose its place covering the entire bed.

DETAILED DESCRIPTION

Figure 1:
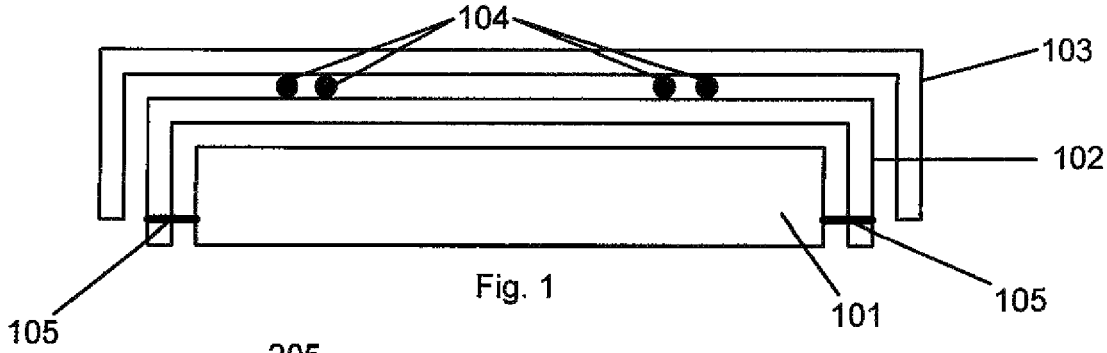
FIG. 1 is a cross section view of an embodiment of a sheet with a detachable waterproof pad.

FIG. 1 depicts the cross section view of one embodiment of a sheet 102 with a detachable waterproof pad 103. In some embodiments, the sheet 102 can be a flat sheet capable of covering anything which a young kid, elderly or bedridden individual can lie down, such as a bed 101 or a couch. A detachable waterproof pad 103 can overhang the sides of the bed 101 so that it is inconspicuous to surrounding people and draws little or no attention to the individual's incontinence problem. The sheet 102 can be secured onto the side of the bed 101 by a fastening mechanism 105. The detachable waterproof pad 103 can be secured to the sheet 102 by a fastening mechanism 104. The fastening mechanism 104 can be any means capable of conveniently and effectively attaching the detachable waterproof pad 103 with the sheet 102, such as snap buttons, hook loop fasteners and the like.

Figure 2A:
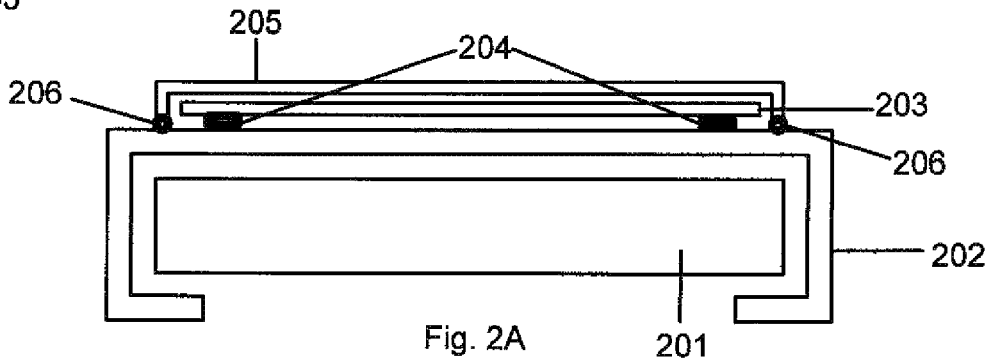
FIG. 2A is a cross section view of an alternative embodiment of a sheet with a detachable water proof pad with a cover on top of it.

FIG. 2A depicts a cross section view of an embodiment in which a cover 205 can be placed on top of a detachable waterproof pad 203 for the purposes of providing extra comfort for the lay down person. The cover 205 also can conceal a detachable waterproof pad 203 so it is inconspicuous. The cover 205 can be made of any material identical to, similar to and/or totally different from the sheet 202.

Figure 2B:
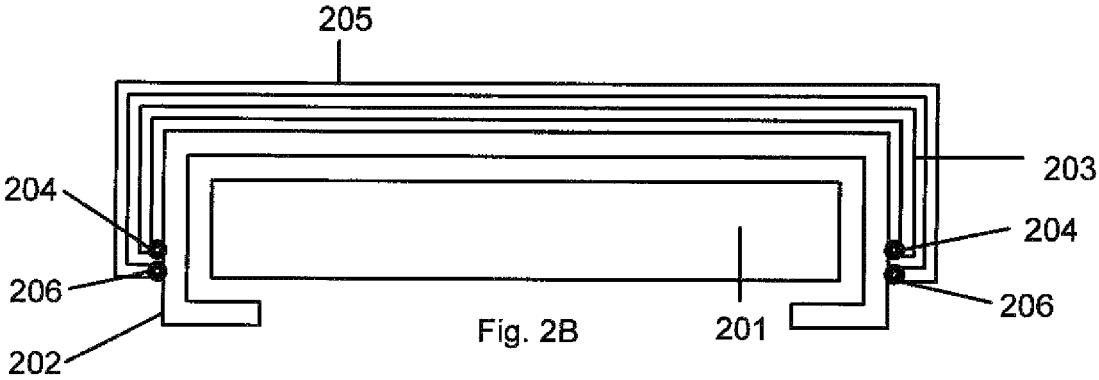
FIG. 2B is a cross section view of a variation embodiment in which the cover overhangs the side of a bed.
Figure 2C:
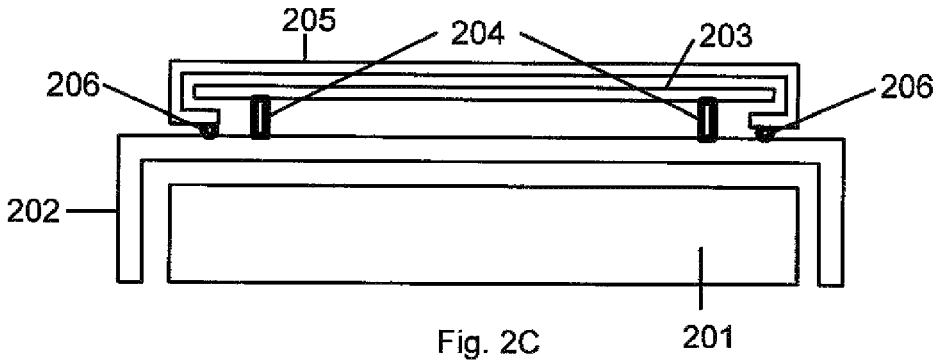
FIG. 2C is a cross section view of a variation embodiment in which the end of cover goes under the detachable waterproof pad.

Although the cover 205 depicted in FIG. 2A does not overhang the sides of the bed 201, FIG. 2B depicts an embodiment in which cover 205 can overhang the sides of bed 201 and can be still long enough to cover the overhung detachable waterproof pad 203 depicted in FIG. 2B. In another embodiment depicted in FIG. 2C, the end of the cover 205 can go underneath detachable waterproof pad 203 so that it can also serve the same purpose of concealing detachable waterproof pad 203 and being visually appealing.

The cover 205 can attach to the sheet 202 by a fastening mechanism 206. The fastening mechanism 206 can be the same as or different from the type of the fastening mechanism 204 which attaches the detachable waterproof pad 203 with the sheet 202.

The location the fastening mechanism 206 through which the cover 205 can attach to can be located anywhere convenient on the sheet 202 or the detachable waterproof pad 203. In one embodiment depicted in FIG. 2A, the fastening mechanism 206 can be located on the top surface of the sheet 202. In an alternative embodiment depicted in FIG. 2B, the fastening mechanism 206 can be located at the far ends of the sheet 202 so they appear to be on the sides of the bed 201. In another alternative embodiment 2C, the fastening mechanism 206 can be on top or beneath the detachable waterproof pad 203 so that the detachable waterproof pad 203 is concealed and inconspicuous.

FIG. 3A to FIG. 3D depict cross-section views of various embodiments of the detachable waterproof pad 301. The detachable waterproof pad 301 can be made of any type of water-resistant, waterproof and/or absorbent materials or any combination of them.

Figure 3A:
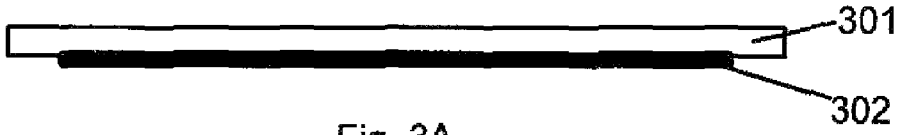
FIG. 3A is a cross section view of an embodiment of a detachable waterproof pad.

One embodiment of a detachable waterproof pad depicted in FIG. 3A can be made entirely by water resistant material such as closely woven cotton, polymer-encapsulated cotton, wax impregnated cotton, epoxy, ceramic, polymer, wood or the like, or any combination of them.

Figure 3B:
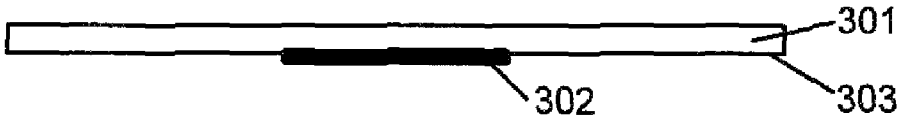
FIG. 3B is a cross section view of an alternative embodiment of a coated/painted detachable waterproof pad.

FIG. 3B depicts an alternative embodiment of a detachable waterproof pad 301. In this embodiment, the body of detachable waterproof pad 301 can be made of any material, but the surface of detachable waterproof pad 301 can be coated or painted with water resistant material, such as spray-on proofer, bitumen, silicate, PVC, HDPE, oil paint, varnish, enamel, and/or plastic paint.

Figure 3C:
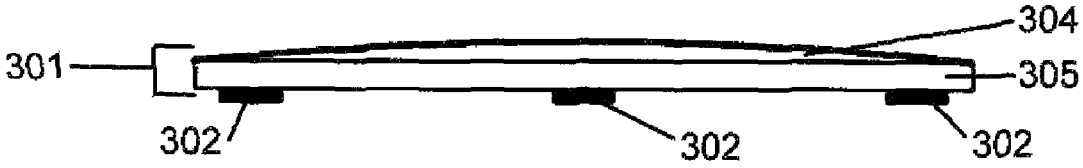
FIG. 3C is a cross section view of an alternative embodiment of a detachable waterproof pad with a water-absorbing upper portion and a water-resistant bottom portion.

FIG. 3C further depicts another embodiment of a detachable waterproof pad 301. The top portion 304 of the detachable waterproof pad 301 can be made of any type of absorbent materials which can serve the function of retaining the waste of the person who lies on it. The bottom portion 305 of the detachable waterproof pad 301 can be made of any type of water-resisting materials which can prevent the waste of the person who lies on it from seeping through the top portion 304 and further contaminating the bed and the sheet for an approximate predetermined period, and/or based on an approximate predetermined volume.

Figure 3D:
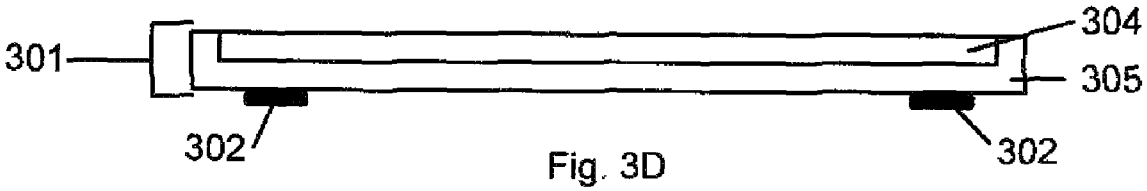
FIG. 3D is a cross section view of a variation of FIG. 3C with a lip on the perimeter of the water-resistant bottom portion.

Furthermore, FIG. 3D depicts another improvement of the FIG. 3C embodiment. In this embodiment, the perimeter of the bottom portion 305 of the detachable waterproof pad 301 has a lip adapted to further secure the waste of the person who lies on it from soiling the sheet and the bed.

Figure 3E:
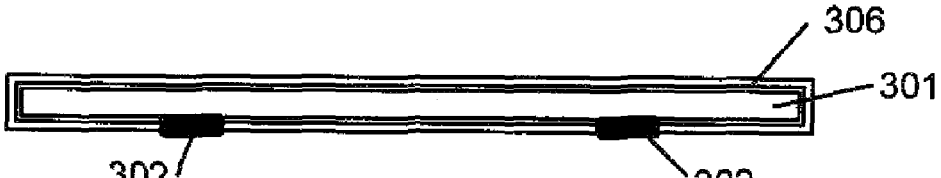
FIG. 3E is a cross section view of a detachable waterproof pad with a wrap around it.

FIG. 3E depicts another embodiment of detachable waterproof pad 301. Warp 306 can be of the same material as that of the bed sheet so that the color, texture and the design between the two matches and the appearance of the whole bed set can be eye-pleasing. Wrap 306 can also itself be absorbent or water resistant so that detachable waterproof pad 301 can be made of any desired materials to provide comfort or support.

The fastening mechanism 302 can be of any number, in any location, and of any size located on the detachable waterproof pad 301. In some embodiments, the fastening mechanism 302 can be on the bottom surface of detachable waterproof pad 301 as shown in FIG. 3A to 3E.

FIG. 3A demonstrates one large single fastening mechanism while FIG. 3B demonstrates a smaller single fastening mechanism. FIG. 3C demonstrates three fastening mechanism while FIGS. 3D and 3E demonstrate two.

The locations of these fastening mechanisms can also vary. Fastening mechanisms can be located at/near the center of the bottom surface of the detachable waterproof pad 301 as shown in FIGS. 3A and 3B, at or close to the edge as shown in FIG. 3C, ED, or somewhere in between as shown in FIG. 3E.

Figure 4A:
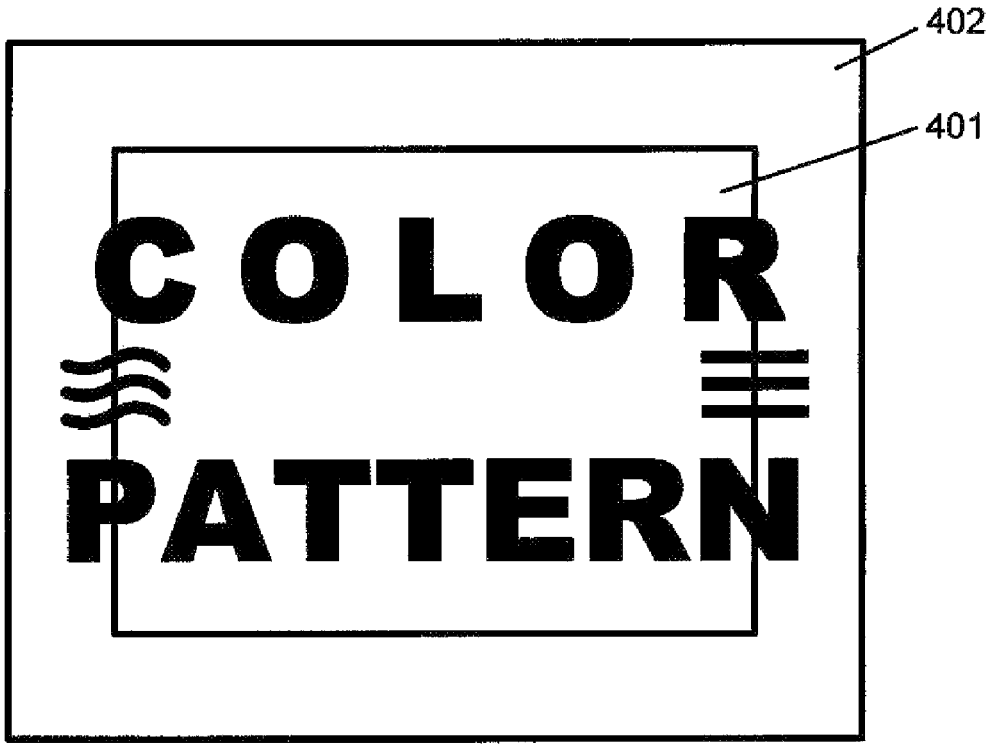
FIG. 4A illustrates how the color and the design pattern between a detachable waterproof pad and a sheet substantially match each other.

FIG. 4A illustrates the appearance of an embodiment depicting how the color, design pattern of a detachable waterproof pad 401 and a sheet 402 substantially matches so that the bed set is eye-pleasing, inconspicuous to the surrounding people and thus draws little or no attention to the incontinence problem of the individual.

Figure 4B:
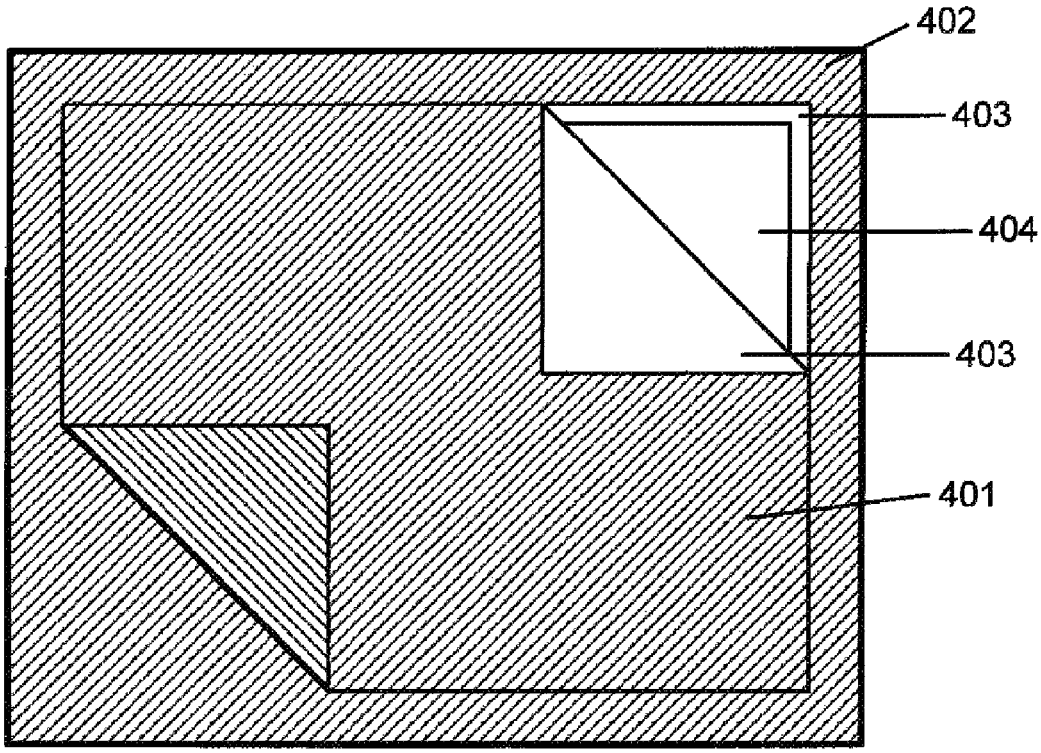
FIG. 4B is a perspective view of an embodiment of a detachable waterproof pad on a sheet and the detachable waterproof pad is cut open.

In FIG. 4A, the color, design pattern can be printed, weaved, knitted, or by other means onto the top of a detachable waterproof pad 401 so to substantially match those of a sheet 402. FIG. 4B further illustrates that a detachable waterproof pad 401 can be comprised of an insert 404 and a wrap 403. The wrap 403 can be of the same material as that of the sheet 402 so that the color, the design, the pattern and even the texture can match accordingly.

However, the illustrations of FIGS. 4A and 4B do not intend to limit the invention set to have a matched appearance. The color, pattern or design between a detachable waterproof pad 401 and a sheet 402 can contrast and/or be unrelated.

Figure 5A:
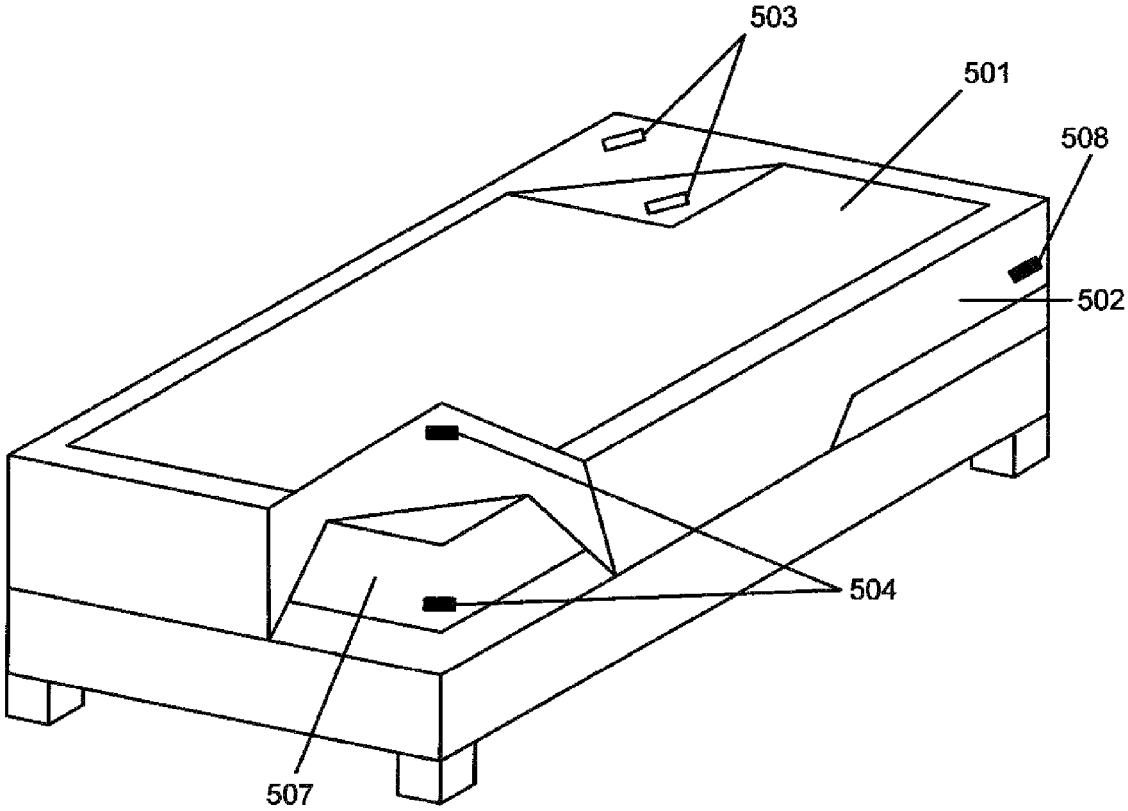
FIG. 5A is a perspective view of having a set of sheet with detachable waterproof pad placed on a bed.
Figure 5B:
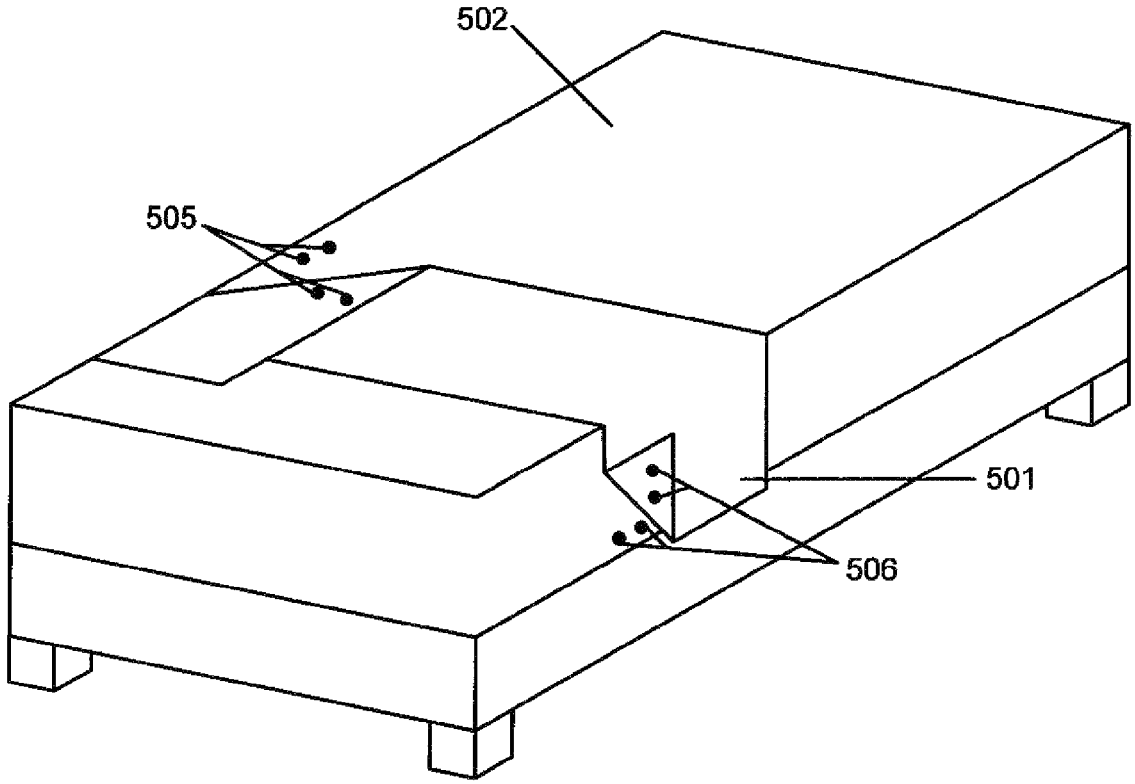
FIG. 5B is a perspective view of having another set of sheet with detachable waterproof pad in which the pad covers the desired area.

FIG. 5A and FIG. 5B demonstrate the size and the shape of a detachable waterproof pad 501 relative to a sheet 502 and a bed 507. The detachable waterproof pad 501 can cover as much as the top surface area of the bed 507 as illustrated in FIG. 5A. FIG. 5B illustrates the shape and size of the detachable waterproof sheet 501 to cover the desired area for the person on bed and can overhang onto the sides of the bed. The size and shape of the detachable waterproof pad is not intended to be limited to these two kinds. It is evident that the size and shape can vary according to the need or wish of the user.

The sheet 502 illustrated in FIG. 5A can be a flat sheet fastened to the bed 507 by a fastening mechanism 508 whereas the sheet 502 illustrated in FIG. 5B can be a fitted sheet. A fastening mechanism 503 attaches the detachable waterproof pad 501 to the sheet 502, and a fastening mechanism 504 attaches the sheet 502 to the bed 507. It is evident that the sheet can be of any desirable type of sheet available. The locations of the fastening mechanism can vary according to the need of the user. The fastening mechanism 505 can be located on the top of the sheet 502, and the fastening mechanism 506 can be located on the overhung side of the sheet 502 as desired. It is evident that the fastening mechanism can be located anywhere as desired.

In one embodiment, either or both of the detachable waterproof pad and the sheet can be cleanable in any ordinary washer and dryer. In other embodiment, either or both of them can be disposable so that the changing of the sheet or the waterproof pad is easy to the caretaker.

In order to replace a water-proof pad, the person on bed can be turned or rolled to one side of the bed and the detachable waterproof pad can be detached from the opposite side, and then the person on bed can be turned to the other side and the detachable waterproof pad can be detached from the other opposite side. Similarly, a clean detachable waterproof pad can be attached in the same manner.

Figure 6:
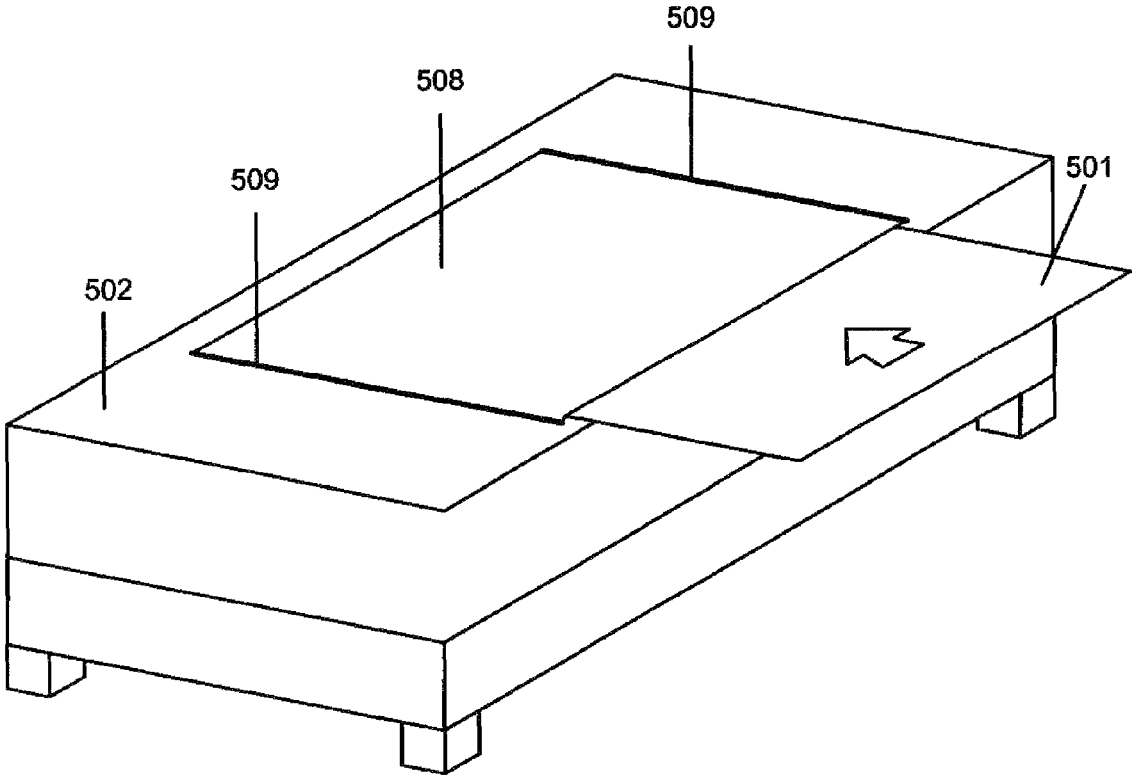
FIG. 6 is a perspective view of an embodiment of a cover, a detachable waterproof pad and a sheet.

FIG. 6 illustrates how a cover 508 can be conveniently used with a sheet 502 and a detachable waterproof pad 501. In this embodiment, the cover 508 can be attached to the sheet 502 by a fastening mechanism 509. The fastening mechanism 509 can be a zipper. The fastening mechanism 509 can only be located on some sides of the cover 508, thus leaving one or more sides unattached so that the detachable waterproof pad 501 can conveniently slide in and out between the sheet 502 and the cover 508. The tautness between the cover 508 and the sheet 502 can provide an adequate fastening mechanism for restraining movement of the detachable waterproof pad 501.

The cover 508 can leave two opposite sides unattached with the sheet 502 so that when one detachable waterproof pad 501 is slid in, the previous one can be conveniently squeezed out, and the person on bed may or may not feel the changing. The detachable waterproof pad 501 can have tapered sides to further the smoothness of the changing.

The cover can have similar color, design pattern or texture to that of the sheet 502 so the difference can be inconspicuous and/or eye-pleasing. The cover 508 can be absorbent or water resistant. The cover 508 can be disposable or cleanable in any ordinary washer and dryer so that it can be convenient to the user.

Although the invention has been described in conjunction with specific embodiments thereof, it is evident that many alternatives, modifications and variations will be apparent to those skilled in the art. Accordingly, the apparatus as described and hereinafter claimed is intended to embrace all such alternatives, modifications and variations that fall within the sprit and broad scope of the appended claims.

What is claimed is:

1. A kit comprising:

a bed sheet;

a detachable pad adapted to selectively couple with said bed sheet;

a fastening mechanism adapted to selectively attach said detachable pad and said bed sheet;

a fastening mechanism to attach said bed sheet to a bed wherein said detachable pad further comprises an absorbent upper layer capable of retaining waste products and a substantially liquid-impermeable bottom layer; and wherein the perimeter of said liquid-impermeable bottom layer further comprising a continuous perimeter lip;

a cover which substantially encloses said detachable pad; and a fastening mechanism located at far ends of said bed sheet for attaching said cover to said bed sheet.

2. The kit of claim 1, wherein said bed sheet is selected from the group consisting of: a flat sheet and fitted sheet.

3. The kit of claim 1, wherein said sheet is disposable.

4. The kit of claim 1, wherein said detachable pad is absorbent.

5. The kit of claim 1, wherein said detachable pad is substantially impermeable to liquid.

6. The kit of claim 1, wherein said detachable pad is disposable.

7. The kit of claim 1, wherein the top surface of said detachable pad has an appearance substantially similar to that of said sheet.

8. The kit of claim 1, wherein the top surface of said cover has an appearance substantially similar to that of said bed sheet.

9. The kit of claim 8, wherein said cover is disposable.

10. The kit of claim 1, wherein said bed sheet is washable and wherein the bed sheet is a fitted sheet.

11. The kit of claim 1, wherein said pad is washable.

12. The kit of claim 1, wherein said cover is washable.

* * * * *